US006076332A

United States Patent [19]

Chick

[11] Patent Number: 6,076,332

[45] Date of Patent: Jun. 20, 2000

[54] PROCESS FOR MANUFACTURING CONTAINERS HAVING HIGH QUALITY, WEATHER RESISTANT GRAPHICS ON EXTERIOR SURFACES

[75] Inventor: Daniel C. Chick, Houston, Tex.

[73] Assignee: Action Box Company, Inc., Houston, Tex.

[21] Appl. No.: 09/013,970

[22] Filed: Jan. 27, 1998

Related U.S. Application Data

[62] Division of application No. 09/013,970, Jan. 27, 1998.

[51] Int. Cl.[7] ..... B65B 61/02

[52] U.S. Cl. ..... 53/411; 493/115; 493/187; 493/188; 493/320

[58] Field of Search ..... 493/187, 188, 493/320, 374, 379, 382, 114, 115, 84; 53/411; 101/453, 463.1, 470

[56] References Cited

U.S. PATENT DOCUMENTS

| | | | |
|---|---|---|---|
| 4,072,099 | 2/1978 | Martin | 101/44 |
| 4,813,351 | 3/1989 | Pierson, Jr. | 101/115 |
| 4,919,554 | 4/1990 | Force | 400/419 |
| 4,963,188 | 10/1990 | Parker | 106/20 |
| 5,182,169 | 1/1993 | Fukuda et al. | 428/343 |
| 5,364,333 | 11/1994 | Gulliver et al. | 493/115 |
| 5,581,978 | 12/1996 | Hekal et al. | 53/411 |
| 5,634,401 | 6/1997 | Weaver | 101/416.1 |

*Primary Examiner*—Eugene L. Kim
*Attorney, Agent, or Firm*—Shook, Hardy & Bacon LLP

[57] ABSTRACT

A method for making weather resistant packaging with high quality graphics on the exterior of packaging material wherein the desired graphics are printed on a thin vinyl sheet with an offset lithographic printing process using solventless, styrene-based, ultraviolet ink on the vinyl substrate. Optionally, a water-based coating can be applied over the cured ink to increase wear resistant attributes of the desired graphics. The vinyl sheet is attached to the packaging material, and an ultraviolet clear coat is placed over the combined vinyl sheet and packaging material. Finally, the combination is cut to form the weather resistant package having the desired graphics.

10 Claims, No Drawings

PROCESS FOR MANUFACTURING CONTAINERS HAVING HIGH QUALITY, WEATHER RESISTANT GRAPHICS ON EXTERIOR SURFACES

CROSS-REFERENCE TO RELATED APPLICATIONS

This application is a division of application Ser. No. 09/013,970 on Jan. 27, 1998.

STATEMENT REGARDING FEDERALLY SPONSORED RESEARCH

Not Applicable.

REFERENCE TO MICROFICHE APPENDIX

Not Applicable.

SPECIFICATION

FIELD OF THE INVENTION

This invention relates to boxes or similar containers. More specifically, this invention relates to a containers having high quality, weather resistant graphics on exterior surfaces and a method to imprint high quality, weather resistant graphics on such containers.

BACKGROUND OF THE INVENTION

Package manufacturers commonly print graphics on their products. Such graphics serve to identify the goods that will go inside the containers. Such manufacturers commonly use known printing processes which are capable of either: (1) imprinting low quality graphics on weather resistant packaging materials, such as using silk screen printing techniques to print on weather resistant vinyl materials, or (2) printing high quality graphics on packaging materials with little or no weather resistance, such as paper stock labels or directly onto cardboard fiber sheets. If a person desires to increase the weather resistance for existing high quality graphics packaging, they must use additional, costly steps to protect the high quality print, such as applying an overlaying, protective material over the printed graphics.

The main problem with these known printing processes involves the desire to place high quality graphics, logos, emblems, or pictures directly on weather resistant packaging materials, whereby the package itself has greater weather resistance qualities without using outer protective layers which add additional cost to the packaging. Until now, persons desiring printing graphics on packaging materials were either limited to low quality printing methods, forced to accept less weather resistant packaging or compelled to pay additional costs to add protective layers.

Thus there is a need to produce high quality, weather resistant graphics on packaged materials at low costs. Therefore, it is desired to have an economical and effective solution to imprint high quality graphics onto packaging materials which are also weather resistant.

BRIEF SUMMARY OF THE INVENTION

It has been discovered that a properly prepared thin vinyl substrate can be used to produce high quality, weather resistant graphics on packaging materials. The invention uses an offset lithographic printing process to imprint solventless, ultraviolet ink, onto the vinyl substrate. The preferred embodiment includes placing a water-based coating on the vinyl substrate over the imprinted graphics to improve its wear resistance. Subsequently, the printed vinyl substrate is attached to flat packaging material, such as solid fiber board, using an adhesive, preferably placed on the back of the vinyl substrate. Finally, the combined packaging material is coated with an ultraviolet clear coating and cut to form the desired package.

BRIEF DESCRIPTION OF THE VIEWS OF THE DRAWINGS

Not Applicable.

DETAILED DESCRIPTION OF THE INVENTION

This invention relates to containers having high quality, weather resistant graphics on exterior surfaces and to a process for printing such graphics on the materials used for packaging. Packaging manufacturers have traditionally used printing processes which either print low quality graphics on weather resistant materials, or print high quality graphics on less weather resistant materials, such as paper and cardboard, and then apply protective overlayers to weatherproof the underlying graphics.

The discovered process permits the manufacturer to imprint high quality, weather resistant graphics in an economical and efficient manner onto materials which form the containers. This process involves printing high quality graphics onto a weather resistant vinyl substrate sheeting using an offset lithographic printing process. An example of this process involves using a high quality polymeric vinyl sheeting, preferably CV400—P Series manufactured by Catalina Plastics & Coating. The preferred polymeric vinyl sheeting has a thickness of about 4 mils and is back coated with a thin coating of an aggressive acrylic permanent pressure sensitive adhesive, creating a vinyl sheeting with a final thickness between about 4.5 and about 4.7 mils. This adhesive backing functions to attach the vinyl sheeting to a solid fiber board after the vinyl sheeting has been printed with the desired graphics. This vinyl sheeting is weather resistant, and it helps make the solid fiber board more weather resistant. This process will also work on corrugated board, but solid fiber board is preferred.

The preferred process uses a sheet-fed press for printing. An offset lithographic printing press using high quality graphics plates imprints the desired image onto the vinyl sheet. It is an essential feature of this process that the offset lithographic printing process use ultraviolet (UV) inks, which are solventless inks that cure with the application of UV light. Such inks not only provide sharp images on the vinyl substrate, but they are also weather resistant. An additional advantage of such inks is that they provide a dry product which is ready for immediate shipping.

Best results have been obtained when using styrene-based inks. Such inks contain high solids, are quick reacting, and are made especially for application on plastic substrates. After printing, a water-based coating, such as Kelstar XT150, can be applied to the surface of the vinyl sheet, over the printed graphics, to help seal the ink to the vinyl substrate and prevent marring of the graphics during the container manufacturing process. This overcoat is not essential to the process, but may provide enhanced protection if desired.

The weather resistant vinyl sheets, imprinted with the high quality, weather resistant graphics, are attached to the desired packaging material. Preferably, the vinyl sheeting is applied to a flat, solid fiber board using an adhesive placed on the back of the vinyl sheet. Typically, the solid fiber board is made from cellulose fibers, and it is more durable than corrugated board. For best results in the adhesion step, the application process should be conducted under temperature conditions above 35° F.

After applying the vinyl sheet to the flat, solid fiber board, an ultraviolet (UV) clear coat, such as Sericol UV Flex or Ink Dezynl UV Flex, can be applied over the printed side of the vinyl to add both a moisture barrier to the packaging and a high gloss for presentation purposes. Of course, the clear coat must be compatible with the surface of the vinyl sheet. For example, if the vinyl sheet has a water-based coat, a clear coat of Ink Dezynl UV Flex would be preferred because it is designed to adhere to that type of surface. On the other hand, if there is no water-based coat, Sericol UV Flex would give the best results. This coating step is complete when the clear coat is cured with ultraviolet radiation.

In the last step of the package manufacturing process, the combined solid fiber/printed vinyl sheet is die cut to the desired size and shape and is stitched using metal stitches to form the final packaging product. This final package manufacturing step is well known in the industry and need not be described further.

The foregoing disclosure and description of the invention are illustrative and explanatory thereof, and various changes in the details of the illustrated method of operation may be made without departing from the spirit of the invention.

What I claim is:

1. A method for making a package having weather resistant, high quality graphics on its exterior, the method comprising:

(a) imprinting the desired graphics on one side of a thin vinyl substrate with a solventless, ultraviolet ink using an offset lithographic printing process;

(b) curing the ink with ultraviolet radiation;

(c) adhering the other side of the thin vinyl substrate to a fibrous sheet to form a combined flat fibrous sheet and a vinyl substrate;

(d) applying a water-based coating after curing the ink and before forming the combined flat fibrous sheet and vinyl substrate; and, (e) forming the package from the combined flat fibrous sheet and vinyl substrate.

2. The method of claim 1 wherein the ink is styrene-based.

3. The method of claim 1 further comprising attaching the vinyl substrate to the packaging materials using adhesives placed on the backside of the vinyl substrate.

4. The method of claim 1 further comprising applying an ultraviolet clear coating to the combined flat fibrous sheet and vinyl substrate.

5. The method of claim 1 further comprising applying an ultraviolet clear coating to the combined flat fibrous sheet and vinyl substrate.

6. The method of claim 1 wherein the fibrous sheet is made from cellulose.

7. The method of claim 6 wherein the fibrous sheet is a solid fiber board.

8. The method of claim 6 wherein the fibrous sheet is a corrugated board.

9. A method of making a package having weather resistant, high quality graphics on its exterior, the method comprising:

(a) imprinting the desired graphics on one side of a thin vinyl substrate with a styrene-based ultraviolet ink using an offset lithographic printing process;

(b) curing the ink with ultraviolet radiation;

(c) adhering the other side of the thin vinyl substrate to a solid fiber board to form a combined solid fiber board and vinyl substrate;

(d) applying an ultraviolet clear coating to the combined solid fiber board and vinyl substrate;

(e) curing the clear coating; and, (f) cutting and stitching the combined solid fiber board and vinyl substrate to form the package.

10. A method of making a package having weather resistant, high quality graphics on its exterior, the method comprising:

(a) imprinting the desired graphics on one side of a thin vinyl substrate with a styrene-based ultraviolet ink using an offset lithographic printing process;

(b) curing the ink with ultraviolet radiation;

(c) applying a water-based coating over the cured ink;

(d) adhering the other side of the thin vinyl substrate to a solid fiber board to form a combined solid fiber board and vinyl substrate;

(e) applying an ultraviolet clear coating over the water-based coating;

(f) curing the clear coating; and, (g) cutting and stitching the combined solid fiber board and vinyl substrate to form the package.

* * * * *